United States Patent [19]

Matsui et al.

[11] Patent Number: 4,627,950

[45] Date of Patent: Dec. 9, 1986

[54] METHOD OF PRODUCING ABRASIVE FIBERS

[75] Inventors: Masao Matsui, Takatsuki; Hiroshi Naito; Takao Osagawa, both of Osaka, all of Japan

[73] Assignees: Kanebo, Ltd., Tokyo; Kanebo Synthetic Fibers, Ltd., Osaka, both of Japan

[21] Appl. No.: 726,526

[22] Filed: Apr. 24, 1985

[51] Int. Cl.[4] ..... D02G 1/20

[52] U.S. Cl. ..... 264/103; 264/139; 264/171; 264/210.6; 264/210.8; 264/232; 264/233; 264/340; 264/341

[58] Field of Search ..... 264/103, 171, 210.6, 264/210.8, 232, 340, 341, 139, 233, 80

[56] References Cited

U.S. PATENT DOCUMENTS 3,551,279 12/1970 Ando et al. ..... 264/171

FOREIGN PATENT DOCUMENTS 0078816 5/1984 Japan ..... 264/341

*Primary Examiner*—Donald Czaja
*Assistant Examiner*—Hubert C. Lorin
*Attorney, Agent, or Firm*—Flynn, Thiel, Boutell & Tanis

[57] ABSTRACT

A method of producing abrasive fibers is disclosed, which comprises providing a conjugate fiber comprising at least one abrasive layer containing abrasive particles and at least one coating layer substantially covering the abrasive layer, and removing at least a part of the coating layer from the conjugate fiber with a solvent or a decomposer to expose at least a part of the abrasive layer from the coating layer.

22 Claims, 11 Drawing Figures

METHOD OF PRODUCING ABRASIVE FIBERS

BACKGROUND OF THE INVENTION

1. Field of the Invention

This invention relates to a method of producing abrasive fibers.

2. Description of the Prior Art

The term "abrasive fiber" used herein means fibers used for rubbing a surface of metal, glass, ceramics, gem, woods, plastics, resin or the like to conduct polishing, cutting, deformation (working), removal of rust and stain, surface finishing and so on, which includes continuous filaments, staple fibers, spun yarns, twisted yarns, cords, knitted goods, woven fabrics, piled cloths, nonwoven fabrics, and fiber structures such as paper and the like.

The abrasive fiber can directly be produced by including abrasive particles into a fiber-forming polymer. In order to produce fibers having excellent abrasion properties, it is required to contain a large amount of particles having a large abrading ability. In this case, however, the guide members, rollers, travelling members, needles and other portions are worn and injured by contacting with the fiber at the fiber production steps such as spinning, drawing, twisting, knitting, weaving and the like, so that the production of the abrasive fibers is very difficult.

SUMMARY OF THE INVENTION

It is, therefore, an object of the invention to solve the aforementioned problems at the production steps and to provide a method of easily producing fibers having high abrasion properties.

Other objects of the invention will be obvious from the contents of the specification hereinafter disclosed.

According to the invention, there is provided a method of producing abrasive fibers, which comprises providing a conjugate fiber comprising at least one abrasive layer compsoed of a polymer containing abrasive particles and at least one coating layer substantially covering the abrasive layer and composed of a polymer containing substantially no abrasive particle, and removing at least a part of the coating layer from the conjugate fiber with a solvent or a decomposer to expose at least a part of the abrasive layer from the coating layer.

DETAILED DESCRIPTION OF THE INVENTION

Figure 1:
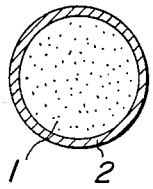
FIGS. 1 to 11 are sectional views of embodiments of the conjugate fiber suitable for use in the invention, respectively.

The conjugate fiber used in the invention comprises at least one abrasive layer and at least one coating layer. The abrasive layer consists of abrasive particles and a polymer binding these particles to each other. This abrasive particles are inorganic particles having a hardness and a particle size in accordance with use purpose, which include mineral particles such as diamond, corundum, topaz, spinel, emery, garnet, flint, ruby, rock crystal, quartz, feldspar, apatite, fluorite, talc, clay and the like; particles of metallic compounds such as silicon carbide (carborundum), silicon nitride, boron carbide, titanium oxide, aluminum oxide (alumina, alundum), zinc oxide, iron oxide, chromium oxide, silicon oxide (silica), cerium oxide, zeolite, ferrite and the like; metallic particles, alloy particles and so on.

The size of the abrasive particle is dependent upon intended use of the abrasive fiber. That is, the abrasive particles having a large particle size are used for cutting or rough finishing, while the abrasive particles having a small particle size are used for high precision finishing. In this connection, the particle size of the abrasive particles is not more than ½ of the diameter of the fiber, preferably not more than ½ of the diameter of the fiber. The ordinary fiber has a diameter (on average) of not more than about 200 μm, particularly not more than 100 μm, more particularly not more than 50 μm. Therefore, the particle size of the abrasive particle is not more than about 100 μm, preferably not more than 50 μm, more preferably not more than 20 μm. Moreover, the abrasive particles having a particle size of about 1–100 μm are well used for medium finishing, while the abrasive particles having a particle size of not more than 5 μm, preferably 0.01–3 μm are well used for high precision finishing. The fibers having a diameter of more than 200 μm, for example, fibers having a diameter of 300–1,500 μm are called bristle and are often different from the ordinary fibers in the production and working processes and the equipments to be used. Although the invention is applicable to such bristles, the intended goal of the invention (i.e. handling properties substantially equal to those of the ordinary fiber at the production and working steps for the ordinary fiber) is most conspicuous in the fibers having the ordinary fiber diameter. In other words, the method according to the invention is particularly aimed at obtaining abrasive fibers for medium or more fine finishing rather than rough cutting.

In order to enhance the adhesion and dispersibility of abrasive particles to the fiber-forming polymer, it is favorable to use a surfactant or a dispersing agent. Preferably, a compound (surfactant) containing a hydrophilic group or a group with affinity for or reactivity with the inorganic particle and a lipophilic group or a group with affinity for or reactivity with the polymer is applied to the surface of the abrasive particle to form a monomolecular membrane or a thin membrane thereon. Further, a so-called coupling agent for bonding the inorganic particles to the polymer, such as silane coupling agent, aluminum series coupling agent, titanate coupling agent or the like is preferably used. The amount of the surfactant or coupling agent used is properly selected in accordance with the use purpose of the abrasive fiber, but it is usually about 0.1~10% (to the weight of the abrasive particle). However, it may be required to be not less than 10%, for example, about 30–100% in the case of abrasive particles wherein the surface area thereof is increased.

The content of abrasive particle in the abrasive layer may be determined in accordance with the use purpose of the abrasive fiber, but it is usually not less than 10% (by weight), preferably 10–90%, more preferably 20–80%, most preferably about 30–75%. In general, the larger the content of abrasive particle, the higher the abrasion force, which tends to reduce the strength of the fiber. In order to retain the strength, therefore, it is favorable that the conjugate fiber also include a reinforcing layer in addition to the abrasive layer and the coating layer.

The polymer for the formation of the abrasive layer may optionally be selected from thermoplastic polymers, preferably fiber-forming polymers. When the conjugate fiber comprises only the abrasive layer and the coating layer, the polymer for the abrasive layer is necessary to have fiber-forming properties. If the conjugate fiber further includes the reinforcing layer, the fiber-forming polymer giving a high strength is used in the reinforcing layer, and the polymer having poor fiber-forming properties can be used in the abrasive layer. Of course, it is most preferable to use the fiber-forming polymer in both the abrasive and reinforcing layers from the viewpoint of the fiber strength. As the thermoplastic of fiber-forming polymer used in the abrasvie layer and the reinforcing layer, mention may be made of polyolefins such as polyethylene, polypropylene and the like; aliphatic polyamides such as nylon-6, nylon-66, nylon-610, nylon-12 and the like; aromatic polyamides such as poly-para-phenylene terephthalamide, poly-meta-phenylene isophthalamide and the like; polyesters such as polyethylene terephthalate, polybutylene terephthalate and the like; polyvinyl polymers such as polyvinyl chloride, polyacrylonitrile, polyvinyl alcohol and the like; polyurethanes, polycarbonates, polyethers, polysulfones and so on. Further, copolymers, mixtures, modified products and derivatives of these polymers may be used. Among them, the polymers having an excellent abrasion resistance such as polyamides and polyesters are particularly preferable for use in the abrasive layer and the reinforcing layer.

Figure 2:
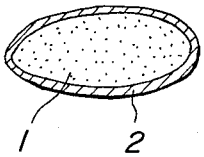
Figure 3:
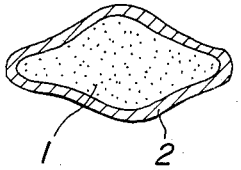
Figure 4:
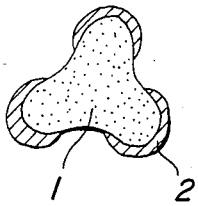

In FIGS. 1 to 11 are sectionally shown embodiments of the conjugate fiber usable in the invention, respectively, wherein numeral 1 is an abrasive layer, numeral 2 a coating layer, numeral 3 a hollow portion and numeral 4 a reinforcing layer. FIG. 1 shows a conjugate shape of a circular sheath-core type, FIG. 2 shows a conjugate shape of a flat sheath-core type, and FIG. 3 shows a conjugate shape of a rectangular sheath-core type. In FIG. 4, the abrasive layer 1 is incompletely covered with the coating layer 2 in such a manner that the exposed portions of the abrasive layer do not substantially contact with the external object (i.e. only the convex portions of the abrasive layer are covered with the coating layer so as to expose the remaining concave portions). Even in the embodiment of FIG. 4, it can be said that the abrasive layer is substantially covered with the coating layer.

In any case, the coating layer must substantially cover the abrasive layer to prevent the contact between the abrasive layer and the external object. In this connection, although the complete covering as shown in FIG. 1 is most preferable, even if the covering is incomplete as shown in FIG. 4, the convex portions of the abrasive layer are sufficiently covered with the coating layer, so that the case of FIG. 4 can be considered as a fact that the abrasive layer is substantially covered with the coating layer. Therefore, the ratio in surface area of the coating layer to the abrasive layer is not less than 50%, preferably not less than 70%, more preferably not less than 80%. Moreover, the coating layer contains substantially no abrasive particle, but may contain somewhat a pigment fsuch as titanium oxide or the like.

Figure 5:
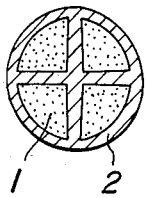
Figure 6:
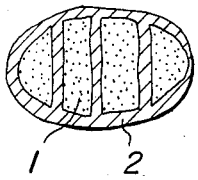
Figure 7:
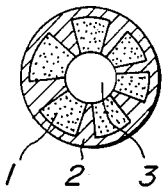

FIG. 5 is the case of dividing the abrasive layer into four segments by the radially extending portions of the coating layer, wherein four fine abrasive fibers are produced by the removal of the coating layer. In such a conjugate fiber having plural cores (corresponding to the abrasive layer), the shape of the core may freely be made into a circle, flat or the like, and the number of cores may be 2 or more (e.g. 3~100). FIG. 6 shows a conjugate shape having plural flat cores, and FIG. 7 shows a conjugate shape having plural cores radially extending from the hollow portion 3. The conjugate fiber of a multi-layer structure having plural cores for the abrasive layer as shown in FIGS. 5 to 7 is fibrilled by a proper means to provide a large number of fine abrasive fibers. An article made from such fine abrasive fibers, for example, an abrasive cloth for precision finishing develops very excellent abrasion properties because the damaging of the object to be polished is diminished due to the fine size of the fiber and the polishing effect is high due to the large contacting area of the fiber. For this purpose, the fineness of the fine fiber (or the core for the abrasive layer in the multi-layer structure) is preferably not more than 1 d, more preferably not more than 0.5 d. In fact, when using the conjugate fiber of the multi-layer structure, it is easy to obtain superfine abrasive fibers having a fineness of about 1–0.01 d. Similarly, in case of the flat abrasive fiber, when the flattening ratio (ratio of long side to short side) is not less than 2, the close contacting property of the fiber is excellent. Preferably, the flattening ratio is not less than 3.

Figure 8:
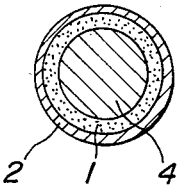
Figure 9:
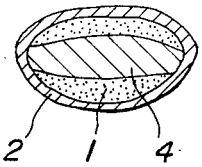
Figure 10:
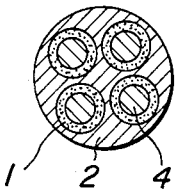
Figure 11:
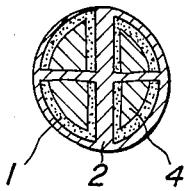

FIG. 8 shows a conjugate shape having the reinforcing layer 4 in addition to the abrasive layer 1 and the coating layer 2. Since the abrasive layer generally tends to reduce the strength, when the abrasive layer is reinforced with the reinforcing layer 4 as shown in FIG. 8, the strength, durability and service life of the resulting abrasive fiber are improved largely and very effectively. In FIG. 8 is shown a case of conjugating the abrasive layer and the reinforcing layer into a core-sheath type structure, while FIG. 9 shows the case of conjugating both the layers into a three layer side-by-side type structure. Of course, the conjugate structure between the abrasive layer and the reinforcing layer may optionally be selected in such a manner that the abrasive layer is sufficiently exposed after the removal of the coating layer. For this purpose, the ratio in surface area of the abrasive layer to the reinforcing layer is at least 5%, preferably not less than 10%, more preferably not less than 30%. In the core-sheath type of FIG. 8, the ratio in surface area of the abrasive layer after the removal of the coating layer is 100%, and that of FIG. 9 is about 88%. If the abrasive layer and the reinforcing layer are arranged in the reverse order in FIG. 9, the ratio in surface area of the abrasive layer after the removal of the coating layer is about 12%, which is included in the scope of the invention. Furthermore, it is easy to apply the reinforcing layer to the conjugate shape of the multi-layer structure as shown in FIGS. 10 and 11. This is, FIG. 10 shows the conjugate fiber having plural cores each composed of the abrasive layer and the reinforcing layer in the sheath-core type, and FIG. 11 shows the conjugate fiber having plural cores each composed of the abrasive layer and the reinforcing layer in the side-by-side type.

In the embodiments of FIGS. 8 to 11, it is favorable that the abrasive layer is sufficiently adhered to the reinforcing layer. For this purpose, the combination of two polymers having an excellent mutual adhesion is preferably used for the abrasive and reinforcing layers. For example, both the polymers are preferably the same or the same kind.

The polymer to be used for the formation of the coating layer is the same as mentioned in the abrasive layer. In this case, however, it is necessary that at least a part of the coating layer can easily be removed by dissolution or decomposition. According to the invention, at least a part of the coating layer is removed without substantially damaging the abrasive layer, whereby at least 10%, preferably not less than 30%, more particularly not less than 50% of the abrasive layer is exposed from the coating layer. Since the coating layer is generally located outside the abrasive layer, even when the decomposition or dissolution rate in the abrasive and coating layers is the same, the coating layer is decomposed or dissolved early. Particularly, it is preferable that the decomposition or dissolution rate of the polymer for the coating layer is larger than that for the abrasive layer (the converse is unsuitable). The selection and combination of the polymers having different decomposition or dissolution rates can easily be determined by those skilled in the art. As a solvent for the polymer, there are known water, dimethylformamide, acetone, xylene, aqueous solution of sodium hydroxide, formic acid, sulfuric acid, nitric acid, phenol, dichloroethane, trichloroethylene, perchloroethylene and the like. In this connnection, the combination of solvent insoluble polymer and solvent soluble polymer can be applied to the abrasive and coating layers of the conjugate fiber. For example, the most part of polyamides are soluble in the acid, while the most part of polyesters are insoluble in the acid. The greater part of acrylic copolymers are soluble in dimethylformamide, acetone or the like, while the greater part of polyamides and polyesters are insoluble in such a solvent. Similarly, the most part of polyesters are easily decomposed in an aqueous solution of strong alkali, while the most part of polyamides are not decomposed in such an aqueous solution. Moreover, the modified polymer containing a third component introduced by copolymerization or mixing process is frequently higher in its decomposition or dissolution rate than the unmodified polymer, so that such a difference in the decomposition or dissolution rate can be utilized. For instance, polyacrylonitrile is insoluble in acetone, while the polymer obtained by copolymerizing acrylonitrile with 30 mol% of vinyl chloride is soluble in acetone. Similarly, polyethylene terephthalate copolymerized with 20% by weight of polyethylene glycol having a molecular weight of 3,500 has a decomposition rate in a 5% aqueous solution of NaOH at 100° C. higher by 50~100 times than that of the homopolymer.

The conjugate ratio (volume ratio) of the coating layer in the conjugate fiber is not critical, but it is preferable to be small as far as possible considering the removal thereof at the subsequent step. That is, the conjugate ratio of the coating layer is not more than 50%, preferably not more than 40%, more particularly not more than 30%. In the embodiment of FIG. 1, the conjugate ratio of the coating layer is about 23%.

The conjugate fiber can be produced by the well-known conjugate spinning method such as melt spinning, dry spinning, wet spinning or the like. In this case, the conjugate fiber may be produced at the usual spinning speed and then subjected to drawing, heat treatment and the like, or the partially oriented fiber (POY) or sufficiently oriented fiber may be produced by the high-speed spinning method. In such a conjugate fiber having the coating layer, the abrasive layer does not directly contact a spinneret, guide members, rollers, travelling members and the like, so that the wearing of these members is less and the production of the fiber is easy.

The conjugate fibers according to the invention can be shaped into a desired structure in accordance with the abrasion purpose. That is, they may be used as a continuous filament or staple with or without crimping alone or may be used together with the other usual fiber as yarns, doubled and twisted yarns, cords, tapes, knitted goods, woven fabrics, nonwoven fabrics (inclusive of spun bond), papers, leather-like articles, sheet-like articles, belt-like articles, piled articles or the like. If necessary, the conjugate fiber may be used to manufacture a roller, a brush, a buff, a rotary disc or the like. Moreover, the mixing of the conjugate fiber according to the invention with the other fiber may be achieved by any means such as filament blending in or after the spinning, doubling, doubling and twisting, staple blending, yarn blending, union knitting, union weaving, paper blending and the like. The mixing ratio of the conjugate fiber in the blend is optional, but it is usually not less than 5% (by weight), preferably not less than 10%, more particularly not less than 20%.

The removal of the coating layer is sufficient to be performed at any step after the spinning and drawing of the conjugate fiber. Particularly, it is preferable that the removal of the coating layer is performed after the abrasive structure is made from the conjugate fiber. For instance, it is favorable to perform the removal of the coating layer after the conjugate fiber is used to manufacture yarn, cord, tape, knitted goods, woven fabrics, nonwoven fabrics, piled articles, paper, sheet-like articles or the like.

According to the invention, the abrasive materials, instruments and devices can easily be produced from fibers each containing abrasive particles therein, which have never or hardly been produced in the prior art.

The following examples are given in illustration of the invention and are not intended as limitations thereof.

In the examples, all parts and percentages are by weight, unless otherwise stated.

EXAMPLE 1

A polyethylene terephthalate copolymerized with 20% of polyethylene glycol having a molecular weight of 3,500 had a molecular weight of 18,000 and was a polymer P1.

A nylon-6 having a molecular weight of 16,000 was a polymer P2, while a nylon-6 having a molecular weight of 18,000 was a polymer P3.

Alumina was calcined and finely pulverized to obtain α-alumina (morundum type) having an average particle size of 0.12 μm, which was an abrasive particle G1.

120 parts of the polymer P2 powder (30 mesh), 80 parts of the abrasive particles G1, 2 parts of magnesium stearate (dispersing agent) and 0.5 part of phenolic antioxidant (Irganox #1098, trade name, made by Ciba Geigy) were mixed and gradually added with 140 parts of a 2.5% aqueous solution of polyvinyl pyrrolidone (tackifier) with stirring to form mixed grains having an average grain size of 3 mm. These grains were dried and then repeatedly subjected to melt kneading in a screw extruder at 270° C. three times, whereby an abrasive particle mixed polymer PG1 was obtained.

Then, the polymer PG1 as the abrasive layer 1 and the polymer P1 as the coating layer 2 were spun into a conjugate form shown in FIG. 1 (conjugate ratio=3/1) through orifices of 0.25 mm in diameter at 280° C. by the melt spinning method, and thereafter the resulting conjugate spin yarn was cooled, oiled and taken up on a bobbin at a rate of 1,200 m/min. Next, this yarn was drawn to 3.2 times at 90° C., which was contacted on a heater at 160° C. and taken up on a bobbin to obtain a drawn yarn Y1. This yarn Y1 had a fineness of 50 d/10 f and a yarn diameter of about 30 μm.

Separately, the conjugate yarn as shown in FIG. 8 was produced by conjugate spinning the polymer PG1 as the abrasive layer 1, the polymer P1 as the coating layer 2 and the polymer P3 as the reinforcing layer 4 at a conjugate ratio (volume ratio) of 1/½ and then subjected to the drawing and heat treatment in the same manner as described on the yarn Y1 to obtain a drawn yarn Y2 having a fineness of 50 d/10 f.

For the comparison, if it was intended to perform the spinning of only the polymer PG1 under the same conditions as described above, the occurrence of yarn breaking was frequent and the spinning was impossible, because the polymer PG1 containing about 50% of the abrasive particles was small in the yarn forming property and the strength of the resulting yarn was low. Now, when the spinning was performed by reducing the content of the abrasive particles in PG1 to 20%, the yarn breaking was somewhat caused, but the spinning and drawing were possible, whereby a drawn yarn Y3 of 40 d/10 f was obtained. In the production of the yarn Y3, however, the damaging of the orifices, traverse guide of winders, guide members and travelling members for drawing machine were conspicuous and the industrial production was fairly difficult. On the contrary, the spinning and drawing for the yarns Y1 and Y2 could be performed in substantially the same manner as in the ordinary yarns. The strength and elongation of each yarn are shown in the following Table 1.

TABLE 1

| Yarn No. | Strength (g/d) | Elongation (%) | Remarks |
|---|---|---|---|
| Y1 | 2.2 | 38 | Invention |
| Y2 | 3.5 | 43 | Invention, reinforcing type |
| Y3 | 2.2 | 35 | Comparative example, content of abrasive particles: 20% |

A pile tricot fabric was knitted by using the yarn Y1 as a front yarn and the usual nylon-6 drawn yarn (70 d/18 f) as a back yarn, treated in a 2% aqueous solution of NaOH at 95° C. for 30 minutes (removal of coating layer), and then dried to obtain an abrasive cloth A1. This cloth A1 is suitable for abrasive finishing of metal, glass, ceramics, synthetic resin and the like and can be used, for example, by adhering to the surface of abrasive belt or roller.

An abrasive cloth A2 was manufactured by using the yarn Y2 instead of the yarn Y1 in the same manner as described above. This cloth A2 had a service life in the abrasive finishing of metal of about 260 hours, which was about 2.7 times that of the cloth A1.

Moreover, the knitting of the yarn Y3 was impossible because the needles in the tricot knitting machine were worn by the yarn Y3.

EXAMPLE 2

A monofilament Y4 having a fineness of 35 d/1 f was produced in the same manner as in the yarn Y2 of Example 1. The monofilament Y4 was taken up on a stainless steel bobbin, treated in a 2% aqueous solution of NaOH at 95° C. for 60 minutes using a cheese dyeing machine to remove the coating layer, and then dried to obtain an abrasive monofilament A3. This abrasive monofilament A3 was run at a speed of 100 m/min under a tension of 20 g through a porcelain rotary guide, to which was contacted a glass rod of 10 mm in diameter at a contact angle of 90°. The glass rod was rotated at a rate of 100 rpm. As a result, the glass rod was cut by the abrasion through the abrasive monofilament A3 in about 2 hours. The abrasive monofilament A3 can be utilized by the cutting and surface working of ceramics, gems and the like in addition to the glass.

EXAMPLE 3

An abrasive particle mixed polymer PG2 was produced in the same manner as in the polymer PG1 of Example 1 by using 70 parts of abrasive particles consisting mainly of silicon carbide with an average particle size of 0.7 μm (carborundum) and containing 2% of a titanate coupling agent (KR-TTS, made by Kenrich Corp,), 130 parts of nylon-12 having a molecular weight of 20,000 and 0.5 part of a phenolic antioxidant (Irganox #1098).

A conjugate yarn as shown in FIG. 9 was produced by conjugate spinning the polymer PG2 as the abrasive layer 1, the polymer P1 of Example 1 as the coating layer 2 and nylon-12 having a molecular weight of 26,000 as the reinforcing layer 4 at a conjugate ratio (volume ratio) of 1½ and then subjected to the drawing and heat treatment in the same manner as described on the yarn Y1 of Example 1 to obtain a drawn yarn Y5 of 250 d/10 f. Thereafter, a cut pile fabric having a filling density of 72 positions/cm$^2$ and a pile length of 25 mm was manufactured by using the drawn yarn Y5 as a pile yarn and a two folded yarn of 30 counts having a blending ratio of nylon-6 staple (3d)/cotton staple=65/35 as a back yarn. This fabric was treated in a 2% aqueous solution of NaOH at 95° C. for 30 minutes to remove the coating layer, dried, backed with a crosslinking type acrylic resin, wound around a roll of 15 cm in diameter and adhered thereto. Then, the resulting assembly was heated (at about 160° C.) by means of an infrared lamp, while being rotated at a rate of 1,800 rpm, to heat-set the piles at an upright state, whereby an abrasive brush A4 was obtained. The brush A4 is suitable for the abrasive finishing of metal, ceramics, wood, synthetic resin and the like.

EXAMPLE 4

An abrasive particle mixed polymer PG3 was produced in the same manner as in the polymer PG1 of Example 1 (at a temperature of 275° C.) by using 30 parts of abrasive particles made of cerium oxide having an average particle size of 0.87 μm, 70 parts of powder of polyethylene terephthalate having a molecular weight of 15,000 and 0.5 part of a phenolic antioxidant (Irganox #1010, made by Ciba Geigy).

Then, the polymer PG3 as the abrasive layer 1 and the polymer P1 of Example 1 as the coating layer 2 were spun into a conjugate form shown in FIG. 2, wherein the thickness of the coating layer was thicker in the direction of its minor axis than in a direction of its major axis, through orifices of 0.25 mm in diameter at 283° C. by the melt spinning method, and thereafter the resulting conjugate spun yarn was cooled, oiled and taken up on a bobbin at a rate of 1,200 m/min. Next, this yarn was drawn to 3.2 times at 80° C., which was contacted on a heater at 150° C. and taken up on a bobbin to obtain a drawn yarn Y6 of 55 d/4 f. In the production of the yarn Y6, the object to be contacted with the yarn was hardly worn at the spinning and drawing steps likewise the case of producing the ordinary yarn, and also no yarn breaking was caused. Then, the yarn Y6 was taken upon on a stainless steel bobbin, treated in a 2% aqueous solution of NaOH at 95° C. for 4, 10 or 20 minutes using a cheese dyeing machine to obtain a yarn Y7, Y8 or Y9 exposing a part of the abrasive layer.

Since the abrasive layer and the coating layer are composed of the polyester series polymer, respectively, they are decomposed with the aqueous solution of NaOH. Now, the same polymer as used in each of the abrasive and coating layers was spun and drawn alone to obtain a drawn filament, which was measured with respect to the decomposition rate in the aqueous solution of NaOH. As a result, the polymer for the coating layer had a decomposition rate larger by about 80 times than that of the polymer for the abrasive layer. Therefore, the substantial reduction and degradation (e.g. reduction of strength) of the abrasive layer in the yarn Y6 were not caused in the treating time as described above.

Each of the yarns Y7–Y9 was run at a speed of 100 m/min under a tension of 20 g through a porcelain rotary guide, to which was contacted a glass rod of 5 mm in diameter at a contact angle of 90°. The glass rod was rotated at a rate of 100 rpm in a direction opposite to the yarn running direction. The time required for cutting through the glass rod with the yarn was measured to obtain a result as shown in the following Table 2. The exposing ratio of the abrasive layer in the yarns Y7–Y9 as measured from the sectional microphotograph thereof is also shown in Table 2. As apparent from Table 2, the yarn having the exposing ratio of less than 5% was poor in the abrasion efficiency and was not yet put to practical use. Moreover, the measured result on the yarn Y6 is also shown in Table 2 for the comparison.

TABLE 2

| Yarn No. | Exposing ratio of abrasive layer (%) | Time required for cutting glass rod (hr) | Remarks |
|---|---|---|---|
| Y6 | 0 | 15< | Comparative Example |
| Y7 | 4.8 | 13.5 | Comparative Example |
| Y8 | 15.4 | 3.8 | Invention |
| Y9 | 32.0 | 1.8 | Invention |

What is claimed is:

1. A method of producing abrasive fibers, which comprises providing a conjugate fiber comprising at least one abrasive layer composed of a polymer containing at least 20% by weight of abrasive particles and at least one coating layer substantially covering the abrasive layer, said coating layer being composed of a polymer containing substantially no abrasive particles, and removing at least a part of the coating layer from the conjugate fiber with a solvent or a decomposer to expose at least a part of the abrasive layer from the coating layer.

2. The method according to claim 1, wherein the conjugate fiber has a sheath-core structure having the abrasive layer as a core.

3. The method according to claim 1, wherein the abrasive layer is flat and the ratio of the long side to the short side is not less than 2.

4. The method according to claim 1, wherein the conjugate fiber has a ratio in surface area of the coating layer to the abrasive layer of not less than 50%.

5. The method according to claim 1, wherein the conjugate fiber further comprises a reinforcing layer.

6. The method according to claim 1, wherein the conjugate fiber comprises a plurality of abrasive layers.

7. The method according to claim 6, wherein the abrasive layer has a fineness of not more than 1 denier.

8. The method according to claim 1, wherein the coating layer is removed with water or aqueous solvent or decomposer.

9. The method according to claim 1, wherein the coating layer has a dissolution or decomposition rate larger by at least 10 times than that of the abrasive layer.

10. The method according to claim 1, wherein the removal of the coating layer is performed ater the manufacture of articles made from the conjugate fiber.

11. A method of producing abrasive fibers, which comprises:

spinning a conjugate fiber having a diameter of not more than 200 micrometers and comprising at least one internal abrasive layer substantially completely enclosed by an external coating layer, said abrasive layer consisting essentially of a blend of from 20 to 80 wt.% of abrasive particles having a particle size of not more than 100 micrometers and the balance is a binder of thermoplastic polymer, said coating layer being free of abrasive particles and consisting essentially of a thermoplastic polymer which can be dissolved or decomposed at a faster rate than said binder, the volume ratio of said coating layer in the conjugate fiber being not more than 50%;

drawing said conjugate fiber and thereafter dissolving or decomposing said coating layer so as to expose not less than 30% of said abrasive layer.

12. A method as claimed in claim 11 in which said abrasive particles are coated with an agent for improving the adhesion and dispersibility of the abrasive particles to the binder, said agent being selected from the group consisting of (a) surfactants having hydrophilic groups which have affinity for or are reactive with the abrasive particles and lipophilic groups which have affinity for or are reactive with the binder, and (b) coupling agents for bonding the abrasive particles to the binder.

13. A method as claimed in claim 11 in which said abrasive layer contains from 30 to 75 wt.% of said abrasive particles.

14. A method as claimed in claim 11 in which said abrasive particles are selected from the group consisting of diamond, corundum, topaz, quartz, feldspar, apatite, fluorite, talc and clay.

15. A method as claimed in claim 11 in which said abrasive particles are selected from the group consisting of silicon carbide, silicon nitride, boron carbide, alumina, alundum, zinc oxide, iron oxide, chromium oxide, silica, cerium oxide, zeolite and ferrite.

16. A method as claimed in claim 11 in which said abrasive particles are selected from the group consisting of alumina, silicon carbide and cerium oxide.

17. A method of producing abrasive fibers, which comprises: spinning a conjugate fiber having a diameter of not more than 200 micrometers and comprising at least one internal reinforcing layer made of a thermoplastic polymer, an abrasive layer at least partially covering and adhered to said reinforcing layer and an external coating layer substantially completely enclosing said reinforcing layer and said abrasive layer, said abrasive layer consisting essentially of a blend of from 20 to 80 wt.% of abrasive particles having a particle size of not more than 100 micrometers and the balance is a binder of thermoplastic polymer, said coating layer being free of abrasive particles and consisting essentially of a thermoplastic polymer which can be dissolved or decomposed at a faster rate than said binder, the volume ratio of said coating layer in the conjugate fiber being not more than 50%;

drawing the conjugate fiber and thereafter dissolving or decomposing said coating layer so as to expose not less than 30% of said abrasive layer.

18. A method as claimed in claim 17 in which said abrasive particles are coated with an agent for improving the adhesion and dispersibility of the abrasive particles to the binders, said agent being selected from the group consisting of (a) surfactants having hydrophilic groups which have affinity for or are reactive with the abrasive particles and lipophilic groups which have affinity for or are reactive with the binder, and (b) coupling agents for bonding the abrasive particles to the binder.

19. A method as claimed in claim 17 in which said abrasive layer contains from 30 to 75 wt.% of said abrasive particles.

20. A method as claimed in claim 17 in which said abrasive particles are selected from the group consisting of diamond, corundum, topaz, quartz, feldspar, apatite, fluorite, talc and clay.

21. A method as claimed in claim 17 in which said abrasive particles are selected from the group consisting of silicon carbide, silicon nitride, boron carbide, alumina, alundum, zinc oxide, iron oxide, chromium oxide, silica, cerium oxide, zeolite and ferrite.

22. A method as claimed in claim 17 in which said abrasive particles are selected from the group consisting of alumina, silicon carbide and cerium oxide.

* * * * *